United States Patent [19]

Ebishi

[11] Patent Number: 5,047,596

[45] Date of Patent: Sep. 10, 1991

[54] MULTI-WAY CHANGE-OVER ROTARY AND SLIDE SWITCH

[75] Inventor: Nobuo Ebishi, Furukawa, Japan

[73] Assignee: Alps Electric Co., Ltd., Tokyo, Japan

[21] Appl. No.: 506,976

[22] Filed: Apr. 9, 1990

[30] Foreign Application Priority Data

Jun. 12, 1989 [JP] Japan ..... 1-67337[U]

[51] Int. Cl.[5] ..... H01H 9/00; H01H 15/00; H01H 25/00

[52] U.S. Cl. ..... 200/4; 200/6 A; 200/315

[58] Field of Search ..... 200/4.5 R, 6 A, 16 R, 200/16 C, 16 D, 11 G, 11 J, 313, 314, 315

[56] References Cited

U.S. PATENT DOCUMENTS

| | | | |
|---|---|---|---|
| 3,005,055 | 10/1961 | Mattke | 200/315 X |
| 3,594,527 | 11/1971 | Brant et al. | 200/11 G X |
| 3,750,080 | 7/1973 | Rouvre et al. | 200/4 |
| 4,166,200 | 8/1979 | Reichen et al. | 200/11 G X |
| 4,245,137 | 1/1981 | Hirai et al. | 200/4 |
| 4,670,633 | 6/1987 | Kaiwa et al. | 200/313 X |
| 4,793,673 | 12/1988 | Keck | 200/315 X |

FOREIGN PATENT DOCUMENTS 56-20904 5/1981 Japan .

*Primary Examiner*—J. R. Scott

*Attorney, Agent, or Firm*—Guy W. Shoup; David W. Heid

[57] ABSTRACT

A multi-way change-over switch which is compact with a reduced number of parts and is improved in operability. The multi-way change-over switch comprises a manually operable lever, a rotary slider supporting the manually operable lever for rocking motion thereon and connected for integral rotation by rotation of the manually operable lever, a rotary switch mechanism having a plurality of contacts which are changed over by rotation of the rotary slider, a slide switch mechanism connected to be slidably moved in a linear direction to change over a plurality of contacts thereof by rocking motion of the manually operable lever, and a controlling mechanism for controlling a direction of sliding movement of a slider of the slide switch mechanism. The manually operable lever can be tilted and rotated to operate the slide switch mechanism and the rotary switch mechanism, respectively, to achieve various switching operations.

4 Claims, 6 Drawing Sheets

MULTI-WAY CHANGE-OVER ROTARY AND SLIDE SWITCH

BACKGROUND OF THE INVENTION

1. Field of the Invention

This invention relates to a multi-way change-over switch, and more particularly to a multi-way change-over switch wherein a manually operable lever supported for rocking motion is tilted in a direction to selectively turn a plurality of switch elements on.

2. Description of the Prior Art

A multi-way change-over switch of the type mentioned is used, for example, as a mirror switch for remotely operating a mirror provided on a body of an automobile from a driver's seat with a driving force of a motor.

An exemplary one of such multi-way change-over switches is disclosed, for example, in Japanese Utility Model Publication No. 56-20904. The conventional multi-way change-over switch is shown in FIGS. 5(*a*) and 5(*b*).

Referring to FIGS. 5(*a*) and 5(*b*), the multi-way change-over switch shown includes an insulator case body 1, and a lower common terminal 2 secured to the bottom of the insulator case body 1. The lower common terminal 2 has four lead wire connecting portions 2*a* which extend downwardly through and from the bottom of the insulator case body 1. An upper common terminal 3 is disposed in an upper opening of the insulator case body 1 in an opposing relationship to the lower common contact 2. The upper common terminal 3 has a lead wire contact connecting portion 3*a* which extends downwardly through and from the bottom of the insulator case body 1.

An upper operating base 4 and a lower operating base 5 are disposed for parallel movement in an opposing relationship to each other on opposing faces of the common terminals 3 and 2, respectively. A motion transmitting means 6 is interposed between the operating bases 4 and 5 for moving, when one of the operating bases 4 and 5 is moved in one direction, the other operating base 5 or 4 in the opposite direction. The motion transmitting means 6 includes four racks 7*a* integrally formed in a square arrangement along four sides on a lower face of the upper operating base 4, another four racks 8*a* integrally formed on an upper face of the lower operating base 5 in an opposing relationship to the racks 7*a* of the upper operating base 4, a floating pinion support member accommodated for movement between the operating bases 4 and 5 and having four pinion shafts 9*a* extending in a cross-like arrangement thereform, and four pinions 11*a* loosely fitted on the pinion shafts 9*a* and held in meshing engagement between individual opposing ones of the racks 8*a* and 9*a*.

Four change-over terminals 12*a* having an L-shaped section in plan are disposed uprightly along four angular corners of an inner wall of the insulator case body 1. Each of the change-over terminals 12*a* has a lead wire connecting portion 13*a* extending downwardly through and from the bottom of the insulator case body 1. A pair of contact elements 14 and 15 are fitted on the upper and lower operating bases 4 and 5 and normally held in contacting engagement with the lower and upper common terminals 3 and 2, respectively. Each of the contact elements 14 and 15 is bent downwardly or upwardly at four side portions thereof and extends downwardly along four side faces of the upper or lower operating base 4 or 5 to form contact portions such that, when the operating base 4 or 5 is moved in one direction, one of the contact portions of the contact element 14 or 15 is brought into contact with an opposing one of the change-over terminals 12.

A manually operable lever supporting member 17 is secured to a lid member 16 disposed on the insulating case body 1, and a lower end portion of a manually operable lever 18 extends through a through-hole 17*a* perforated at the center of the supporting member 17. The manually operable lever 18 has four supporting projections 19 formed at a vertically mid portion thereof. The supporting projections 19 extend laterally in a cross-like arrangement from the manually operable lever 18 and are received on an upper face of the supporting member 17. The support member 17 further has four supporting slits formed in a cross-like arrangement in plan around the through-hole 17*a*, and the supporting projections 19 of the manually operable lever 18 are individually fitted in the supporting slits of the support member 17 to prevent the manually operable lever 18 from rotating around its axis. An E-shaped snap ring 20 is snapped at a location a little above the lower end of the manually operable lever 18, and a helical spring 21 having a tapered shape in side elevation is interposed between the E-shaped snap ring 20 and a lower face of the supporting member 17 to normally urge the manually operable lever 18 to assume an upright position with respect to the supporting member 17.

By the way, with such conventional multi-way change-over switch, the manually operable lever 18 is supported for rocking motion in four perpendicular directions, and a mirror is driven to move in one of four directions, for example, upward, downward, leftward and rightward directions, in accordance with a direction in which the manually operable lever 18 is tilted. Accordingly, when one of two left and right mirrors is to be operated, such mirror must be selected, and to this end, a slide switch is provided separately. This requires an additional part and an additional space for the part. Besides, when the other mirror is to be selected, a finger is removed from the manually operable lever 18 once, and then, after such selection is made, the finger is returned to the manually operable lever 18 to operate the latter again. A cumbersome manual operation is thus required.

SUMMARY OF THE INVENTION

It is an object of the present invention to provide a multi-way change-over switch which is compact with a reduced number of parts and is improved in operability.

In order to attain the object, according to the present invention, there is provided a multi-way change-over switch which comprises a manually operable lever, a rotary slider supporting the manually operable lever for rocking motion thereon and connected for integral rotation by rotation of the manually operable lever, a rotary switch mechanism having a plurality of contacts which are changed over by rotation of the rotary slider, a slide switch mechanism connected to be slidably moved in a linear direction to change over a plurality of contacts thereof by rocking motion of the manually operable lever, and a controlling mechanism for controlling a direction of sliding movement of a slider of the slide switch mechanism.

With the multi-way change-over switch, the manually operable lever can be tilted to operate the slide switch mechanism. On the other hand, when the manually operable lever is rotated around its axis, the rotary slider connected for integral rotation with the manually operable lever is rotated to operate the rotary switch mechanism.

By suitably rotating and/or tilting the manually operable lever, various switching operations can be achieved in this manner.

The multi-way change-over switch is thus compact in size with a reduced number of components and is improved in operability.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
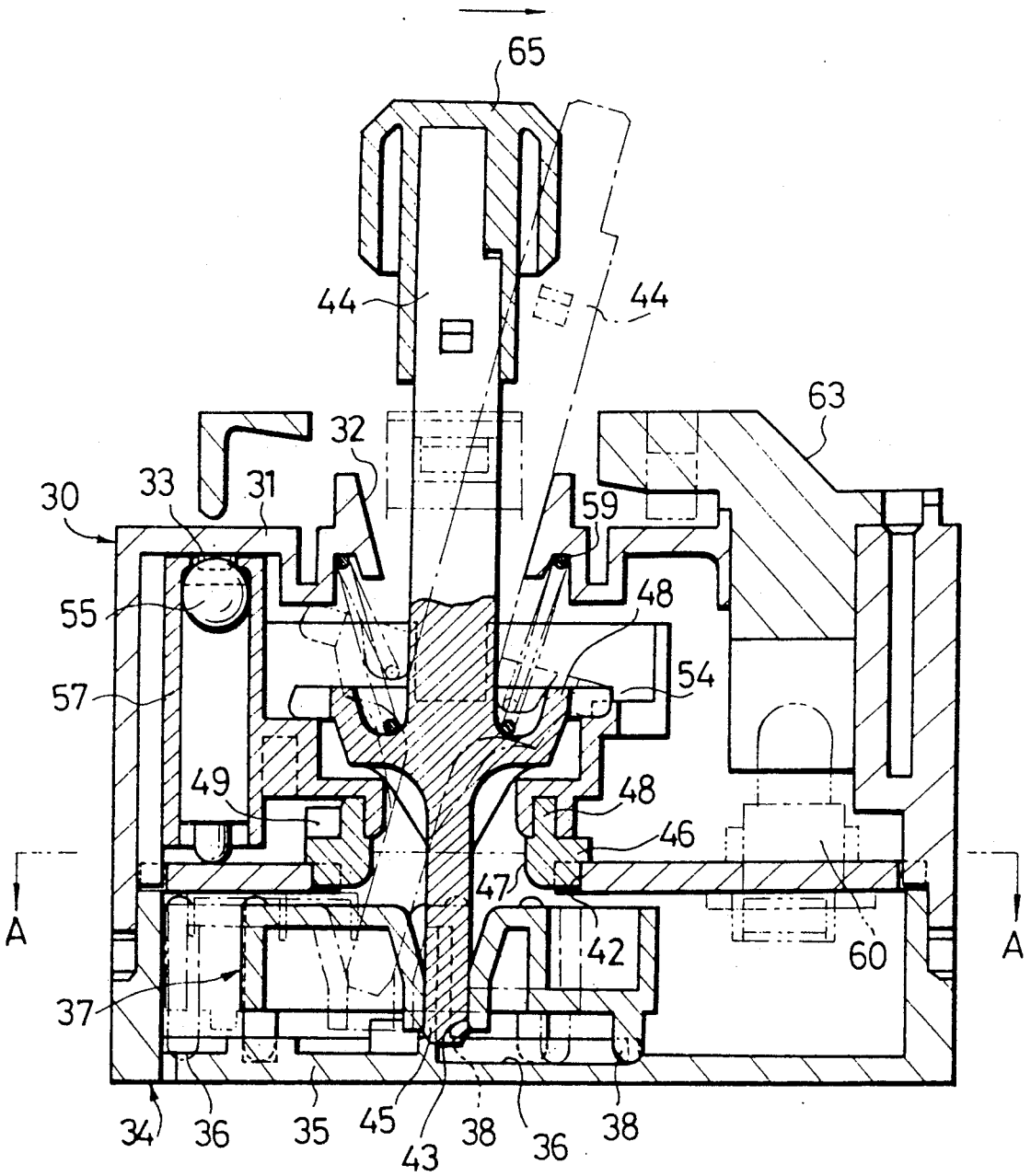
FIG. 1 is a vertical sectional view of a multi-way change-over switch showing a preferred embodiment of the present invention.
Figure 2:
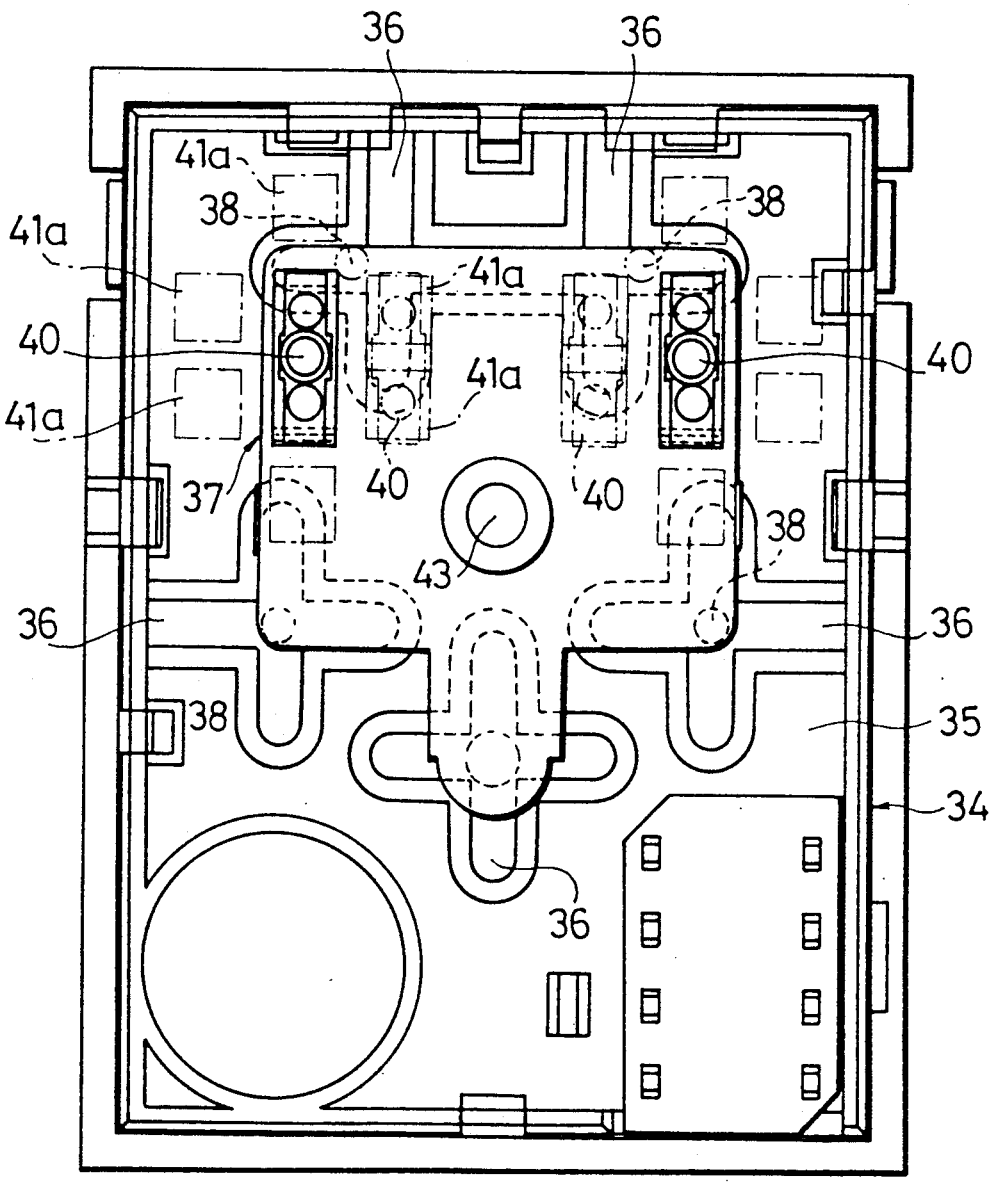
FIG. 2 is a sectional view taken along line 2—2 of FIG. 1.
Figure 3:
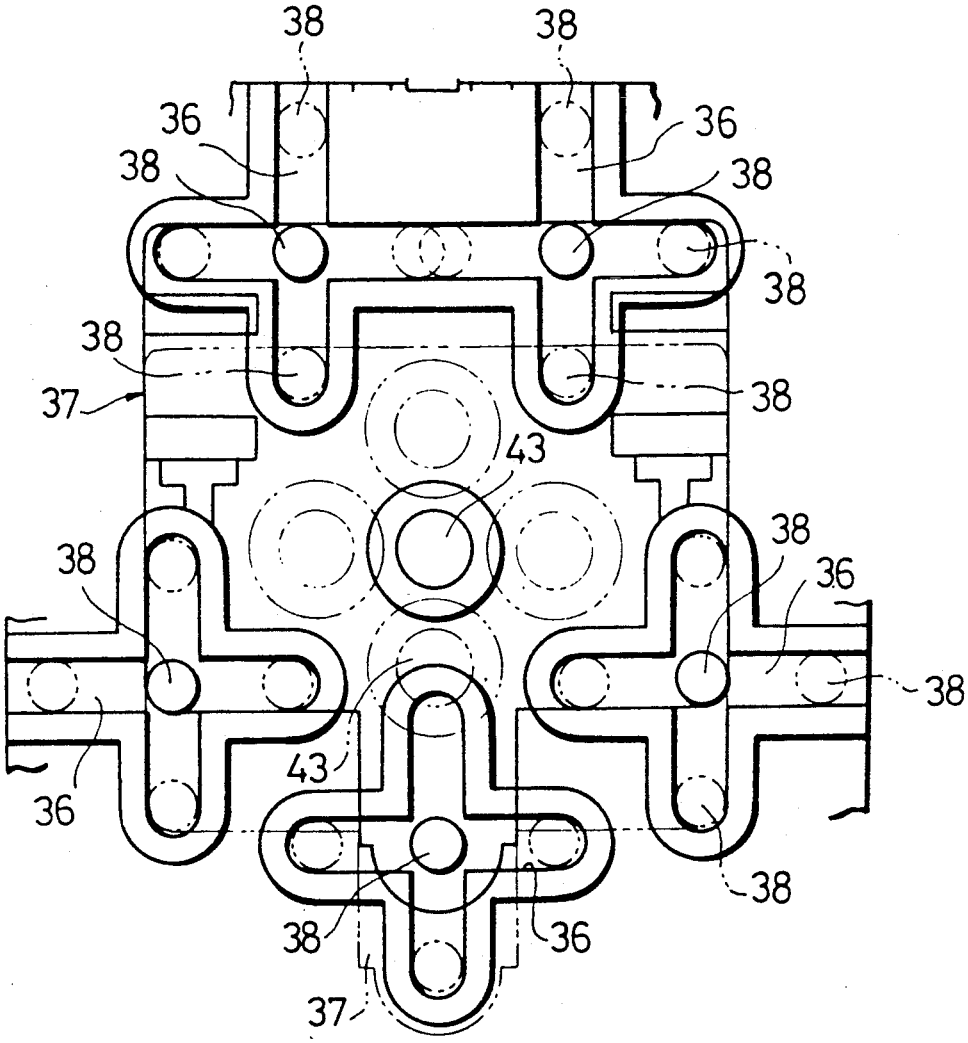
FIG. 3 is a schematic view illustrating operation of a slider of the multi-way change-over switch of FIG. 1.
Figure 4:
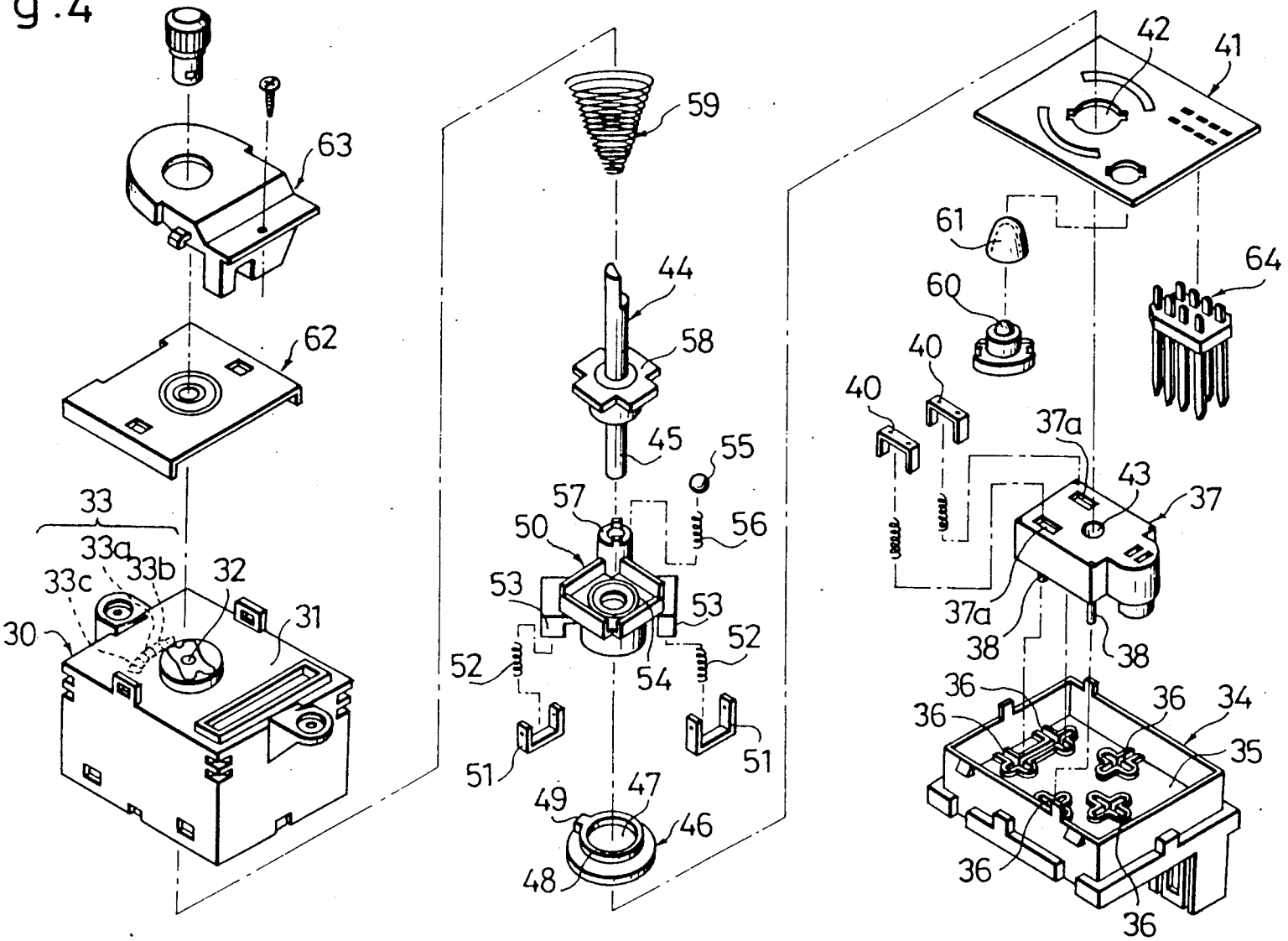
FIG. 4 is a fragmentary perspective view of the multi-way change-over switch of FIG. 1.
Figure 5A:
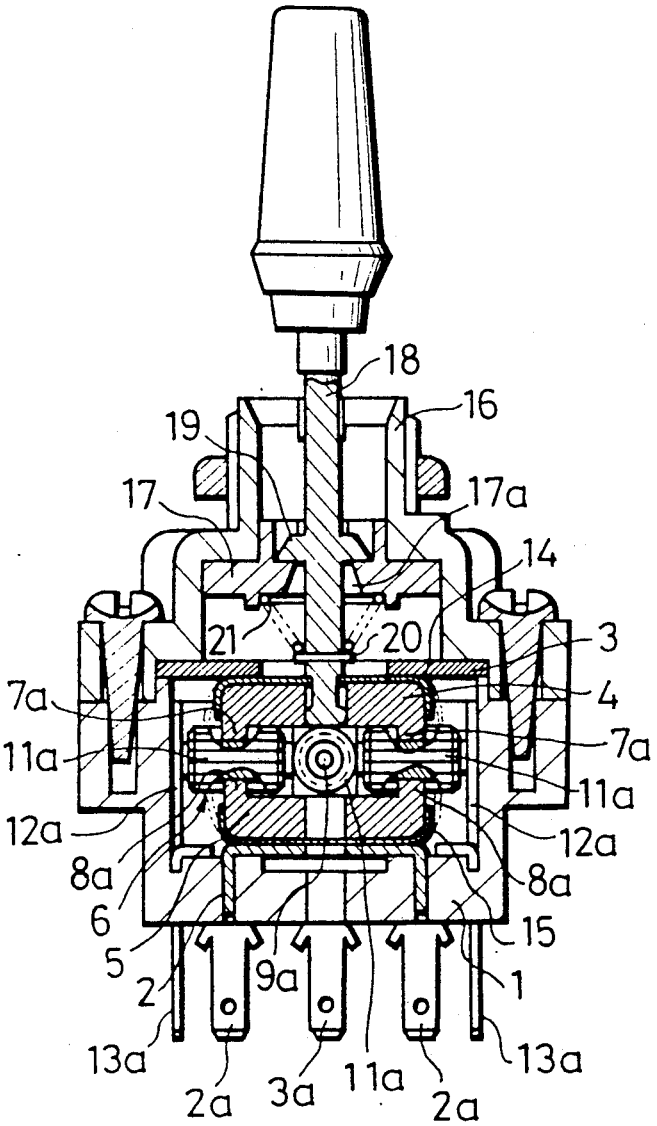
Fig.5(a) PRIOR ART
FIGS. 5(*a*) and 5(*b*) are sectional views showing a conventional multi-way change-over switch.
Figure 5B:
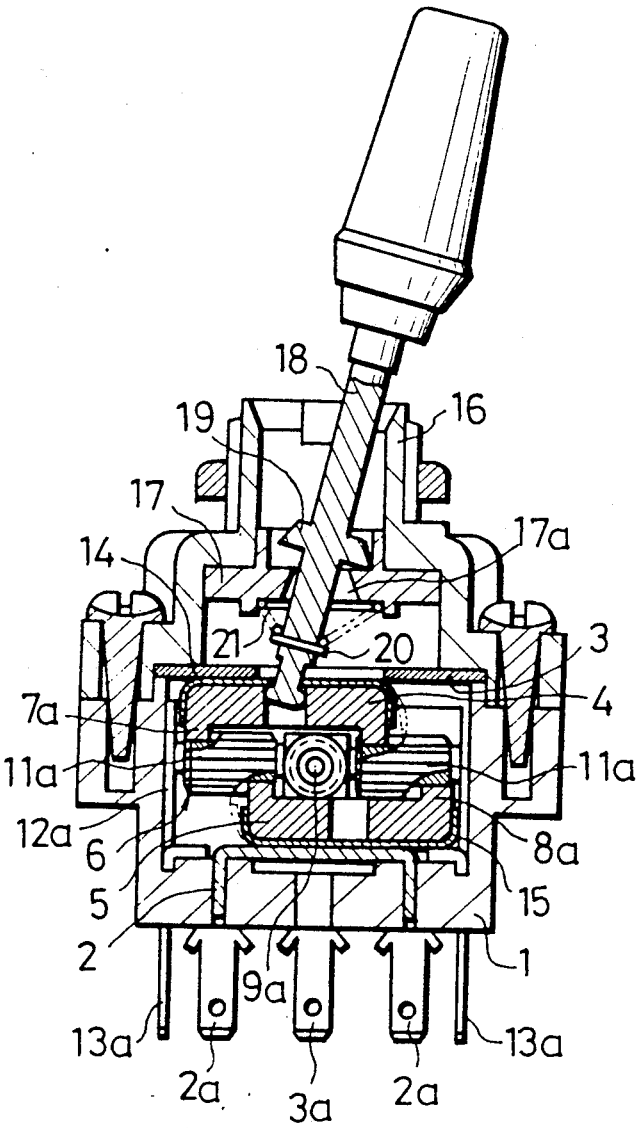
Fig.5(b) PRIOR ART

Referring to FIGS. 1 to 4, there is shown a multi-way change-over switch to which the present invention is applied. The multi-way change-over switch shown includes a case 30 which is opened at the bottom thereof. The case 30 has a top wall 31 having a through-hole 32 perforated at a central portion thereof. The through-hole 32 has a cross-like shape in plan and is expanded laterally outwardly at an upper portion thereof. A cam section 33 is provided on a lower face of the top wall 31 and extends in an arc centered at the center of the through-hole 32. The cam section 33 has three positioning portions 33*a*, 33*b* and 33*c* corresponding respectively to a central position, a right position and a left position of a manually operable lever in rotating operation which will be hereinafter described.

The multi-way change-over switch further includes a cover 34 for closing the open bottom of the case 30. The case 30 and the cover 34 are snap-coupled to each other to form an outer housing of the multi-way change-over switch. Five guide grooves 36 having a cross-like shape in plan are formed in a pentagonal arrangement on an upper face of a bottom wall 35 of the cover 34. A slider 37 is placed on the bottom wall 35 of the cover 34 for movement in four perpendicular directions. In particular, five pins 38 are provided on a lower face of the slider 37 and individually fitted for sliding movement in the guide grooves 36 of the bottom wall 35 of the cover 34. The slider 37 further has a pair of openings 37*a* formed in an upper wall thereof, and a sliding element 40 is accommodated in each of the openings 37*a* and normally urged by a coil spring 39 so that it is resiliently contacted with a lower face of a printed circuit board 41 disposed above the slider 37. The printed circuit board 41 is held in position between the lower end of the case 30 and the upper end of the cover 34. The printed circuit board 41 has several change-over contacts 41*a* formed on a lower face thereof for providing four different change-over conditions corresponding, for example, to movements of a mirror in upward, downward, leftward and rightward directions. The sliding elements 40 are disposed for sliding movement on the change-over contacts 41*a* to effect changing over of the contacts. A slide switch mechanism is formed in this manner. The printed circuit board 41 has a through-hole 42 perforated therein together with a pair of detecting recesses while an engaging hole 43 is perforated in the upper wall of the slider 37. A manually operable lever 44 extends through the through-hole 42 of the printed circuit board 41 and is fitted at a lower end portion 45 thereof in the engaging hole 43 of the slider 37 so that the slider 37 may be slidably moved by a tilting operation of the manually operable lever 44.

A spacer 46 is fitted in the through-hole 42 of the printed circuit board 41 and has a through-hole 47 perforated therein. The spacer 46 further has a cylindrical portion 48 formed along a circumferential edge of the through-hole 47 on an upper face thereof and has a stopper element 49 formed adjacent the cylindrical portion 48. A rotary slider 50 is fitted for rotation on the cylindrical portion 48 of the spacer 46 and has a pair of accommodating portions 53 in each of which a sliding element 51 for receiving a coil spring 52 is accommodated. The sliding elements 51 are normally urged upwardly by the coil springs 52 so that they are resiliently pressed against an upper face of the printed circuit board 41. Thus, the sliding elements 51 are slidably moved on a pair of arcuate change-over contacts formed on the upper face of the printed circuit board 41 for providing change-over positions, for example, for alternative movement of a left-hand side mirror or a left-hand side mirror. A rotary switch mechanism is constructed in this manner. The rotary slider 50 has a through-hole formed therein through which the manually operable lever 44 extends. The rotary slider 50 further has an upwardly opened bearing portion 54 of a square box-like shape formed around an upper opening of the through-hole on an upper face thereof. The rotary slider 50 has an additional accommodating portion 57 in which a steel ball 55 for the click stopping and a coil spring 56 are accommodated. The steel ball 55 is normally urged upwardly by the coil spring 56 into resilient contact with the cam portion 33 of the case 30, thereby constituting a click stop mechanism.

The manually operable lever 44 has a generally bar-like shape, and a flange portion 58 having an octagonal outer periphery is provided at a vertically mid portion of the manually operable lever 44. The flange portion 58 of the manually operable lever 44 is normally supported in the bearing portion 54 of the rotary slider 50. Since the outer periphery of the flange portion 58 has an octagonal shape (having eight summits) and the positioning portions 33*a* to 33*c* of the cam section 33 are disposed within an angular range of 45 degrees, when the manually operable lever 44 is manually rotated, one of the sides of the flange portion 58 may be engaged with the bearing portion 54 of the rotary slider 50 to provide a fulcrum. A conical coil spring 59 is interposed with its smaller diameter end portion directed downwardly between an upper face of the flange portion 58 and the lower face of the top wall 31 of the case 30 to normally urge the flange portion 58 of the manually operable lever 44 downwardly toward the rotary slider 50.

The multi-way change-over switch further includes a lamp 60 fitted in the printed circuit board 41, a color cap 61 for covering the lamp 60, a light pipe 63 for passing therethrough and introducing light from the lamp 60 to project upon a location around the manually operable lever 44, a packing 62 disposed between the top wall 31 of the case 30 and the light pipe 63, a plurality of connecting terminals 64 inserted in the printed circuit board 41 for interconnecting the change-over contacts on the opposite faces of the printed circuit board 41, and a knob 65 fitted at the top end of the manually operable lever 44.

Subsequently, operation of the multi-way change-over switch of the embodiment will be described.

When the manually operable lever 44 is at its neutral position indicated in solid lines in FIG. 1, the flange portion 58 of the manually operable lever 44 is resiliently pressed against the rotary slider 50 by the conical coil spring 59 so that the manually operable lever 44 assumes such an upright position as shown in FIG. 1. In this instance, the guide pins 38 of the slider 37 are positioned at the cross points of the cross-shaped guide grooves 36 of the cover 34. Meanwhile, the steel ball 55 of the click stop mechanism is positioned at its central position, that is, resiliently pressed against the central positioning portion 33*a* of the cam section 33 on the top wall 31 of the case 30 to retain the manually operable lever 44 at the position.

Then, when the right-hand side mirror is to be operated, the knob 65 will be operated to rotate the manually operable lever 44 in the clockwise direction around its axis. Since the flange portion 58 of the manually operable lever 44 is fitted in the bearing portion 54 of the rotary slider 50, the rotary slider 50 which is supported for rotation in the cylindrical portion 48 of the spacer 46 is rotated in an integral relationship by the manually operable lever 44. Upon such rotational movement of the rotary slider 50, the sliding elements 51 are slidably moved on the upper face of the printed circuit board 41 to effect changing over of the contacts. Upon such changing over, the steel ball 55 is slidably moved on the cam section 33 by rotation of the rotary slider 50 until it is engaged with and stopped at the positioning portion 33*b* of the cam portion 33 for the right position. Accordingly, the manually operable lever 44, which is connected for integral rotation with the rotary slider 50, is retained at the right position. Consequently, the right-hand side mirror is enabled to be driven subsequently.

Then, when the right-hand side mirror is to be driven to move upwardly, a force acting in the direction indicated by an arrow mark in FIG. 1 will be applied to the knob 65 of the manually operable lever 44 in the neutral position. Thereupon, a right side edge in FIG. 1 of the flange portion 58 of the manually operable lever 44 is engaged with the bearing portion 54, and the manually operable lever 44 is tilted rightwardly in FIG. 1 around a fulcrum provided by the right side edge of the flange portion 58 while contracting the coil spring 59. Upon such tilting motion of the manually operable lever 44, the lower end portion 45 of the manually operable lever 44 is moved leftwardly as shown in phantom in FIG. 1 so that the slider 37 held in engagement therewith is slidably moved leftwardly in FIG. 1. Upon such sliding movement of the slider 37, the sliding elements 40 on the upper face of the slider 37 are slidably moved on the change-over contacts 41*a* on the lower face of the printed circuit board 41 to change over the contacts. During the sliding movement of the slider 37, each of the guide pins 38 on the slider 37 is moved along a portion of a corresponding one of the cross-shaped guide grooves 36 from the cross point of the guide groove 36 (refer to FIG. 3). Consequently, the motor is energized to move the mirror upwardly.

Then, after completion of adjustment of the mirror, the force upon the manually operable lever 44 will be cancelled. Consequently, the manually operable lever 44 is moved reversely back to the neutral position shown in FIG. 1 by the urging force of the coil spring 59. Simultaneously, the slider 37 is returned to its original position.

It is to be noted that, when the right-hand side mirror is to be moved downwardly, rightwardly or leftwardly, the manually operable to lever 44 is manually tilted in a corresponding direction similarly as described above. On the other hand, when the left-hand side mirror is to be driven, the manually operable lever 44 is rotated reversely around its axis to engage the steel ball 55 with the positioning portion 33*c* of the cam section 33 on the case 30 for the left position to effect changing over of the contacts.

With the multi-way change-over switch of the embodiment described above, since it comprises the manually operable lever 44, the rotary slider 50 supporting the manually operable lever 44 for rocking motion thereon and connected for integral rotation by rotation of the manually operable lever 44, the rotary switch mechanism having the plurality of contacts which are changed over by rotation of the rotary slider 50, the slide switch mechanism connected to be slidably moved in a linear direction to change over the plurality of contacts thereof by rocking motion of the manually operable lever 44, and the controlling mechanism for controlling a direction of sliding movement of the slider 37 of the slide switch mechanism, the manually operable lever 44 can be tilted and/or rotated and can achieve various switching operations in accordance with such tilting and rotating movements. Further, the multi-way change-over switch can be made compact with the number of components reduced and can be improved in operability.

Further, since the conical coil spring 59 is used for the returning operation of the manually operable lever 44, the manually operable lever 44 can be returned to its neutral position only by means of the coil spring 59 without additional provision of a separate coil spring for the returning movement, for example, on the slider 37.

Besides, since the outer periphery of the flange portion 58 of the manually operable lever 44 is formed in an octagonal shape, one of the sides of the flange portion 58 acts as a fulcrum, and accordingly, even if the manually operable lever 44 is manually rotated around its axis and then tilted, such operation can be carried out stably.

In addition, since the change-over contacts are formed and the rotary slider 50 and the slider 37 are disposed on the opposite faces of the printed circuit board 41, the printed circuit board 41 can be reduced in amount of use and also in spacing. Further, since the rotary slider 50 and the slider 37 are operated separately from each other, a changing over operation can be achieved with certainty without being influenced by operation of the other element. Due to such construction as described above, it is possible to manually rotate the manually operable lever 44 around its axis while the manually operable lever 44 is held in a tilted condition, and the multi-way changeable switch can cope with various switching operations.

What is claimed is:

1. A multi-way change-over switch, comprising:

a manually operable lever having first and second ends, said lever including a planar protrusion positioned intermediate said first and second ends;

a rotary slider including electrically conducting contacts, said rotary slider supporting said manually operable lever for rocking motion thereon, and said rotary slider further including a flange portion comprising a plurality of sides, wherein each side of said flange portion acts as a fulcrum with said planar protrusion of said manually operable lever, whereby rotation of said manually operable lever also rotates said rotary slider;

a printed circuit board having a plurality of contacts on first and second sides of said printed circuit board and a through hole which allows passage of said manually operable lever, said printed circuit board supporting said rotary slider on said first side;

a cover which supports said printed circuit board; and a slide switch mechanism disposed between said printed circuit board and said cover, said slide switch mechanism including electrically conductive contacts supported in operative relationship with contacts on said second side of said printed circuit board, said slide switch mechanism further including means coupling said slide switch mechanism to said manually operable lever;

wherein rotation of said manually operable lever rotates said rotary slider over one group of said plurality of contacts on said first side of said circuit board and rocking of said manually operable lever slides said slide switch mechanism over another group of said plurality of contacts on said second side of said circuit board.

2. The multi-way change-over switch of claim 1, wherein said slide switch mechanism comprises a plurality of projections, and further wherein said cover has a plurality of guide grooves disposed therein, and further wherein said projections are disposed in operative relationship with said grooves to thereby guide the sliding movement of said slide switch mechanism.

3. The multi-way change-over switch of claim 1, wherein said switch further comprises a spring coupled to said manually operable lever for urging said manually operable lever to a neutral position.

4. The multi-way change-over switch of claim 1, wherein said printed circuit board includes a lamp, and further wherein said multi-way change-over switch includes a light-transmitting means having one portion positioned adjacent to said lamp and another portion positioned to said manually operable lever for transmitting light from said lamp onto said manually operable lever.

* * * * *